US005581331A

United States Patent [19]

Teshigawara et al.

[11] Patent Number: 5,581,331

[45] Date of Patent: Dec. 3, 1996

[54] COLOR IMAGE FORMING APPARATUS

[75] Inventors: Toru Teshigawara; Toshiaki Sagara; Yasuki Yamauchi; Takuto Tanaka, all of Nakai-machi; Haruyuki Nanba, Ebina, all of Japan

[73] Assignee: Fuji Xerox Co., Ltd., Tokyo, Japan

[21] Appl. No.: 547,461

[22] Filed: Oct. 24, 1995

[30] Foreign Application Priority Data

Jan. 13, 1995 [JP] Japan ..... 7-021284

[51] Int. Cl.[6] ..... G03G 15/02

[52] U.S. Cl. ..... 355/225; 355/222; 355/326 R; 430/902

[58] Field of Search ..... 355/326 R, 327, 355/221, 222, 225; 430/35, 902; 347/115

[56] References Cited

U.S. PATENT DOCUMENTS 5,453,822 9/1995 Anzai et al. ..... 355/326 R

FOREIGN PATENT DOCUMENTS 60-76766 5/1985 Japan .
3-36230 5/1991 Japan .
3-209274 9/1991 Japan .

*Primary Examiner*—R. L. Moses
*Attorney, Agent, or Firm*—Oliff & Berridge

[57] ABSTRACT

In a color image forming apparatus, charging, exposure and development are repeated thereby a plurality of color component toner images are formed in superposing on an image carrier and then transferred collectively to an image receptor. As a charging device used in image forming cycle of at least the second color or later, a corona charging device having a discharge electrode and a grid is used. An electrode power source applying at least AC voltage is connected to the discharge electrode, and a grid power source applying AC voltage in nearly the same phase as that of the AC voltage applied to the discharge electrode is connected to the grid, and frequency or peak-to-peak amplitude of the AC voltage from the grid power source is set to optimum range.

5 Claims, 11 Drawing Sheets

COLOR IMAGE FORMING APPARATUS

BACKGROUND OF THE INVENTION

1. Field of the Invention

The present invention relates to color image forming apparatuses, and more particularly to improvement of a color image forming apparatus where charging, exposure and development are repeated plural times on an image carrier thereby a plurality of toner images are formed in superposing and then transferred collectively to an image receptor.

2. Prior Art

In the prior art, various image forming apparatuses are proposed where after charging, exposure and development are repeated plural times and a plurality of toner images being different in color are formed on an image carrier, these toner images are transferred collectively to a recording paper thereby color images are obtained (e.g., JPA No. 76766/1985).

As a charging device used in such a color image forming apparatus, for example, that shown in FIG. 16 is known where a DC power source 103 is connected to a corona wire 102 of a corona charging device (scorotron) 100 having a grid 101, and at the same time prescribed control bias voltage is applied to the grid 101 and charging voltage of an image carrier 104 is controlled to level of the control bias voltage of the grid 101.

Also as shown in FIG. 17, such a two-color image forming apparatus is provided that charging of the image forming cycle of the first color is carried out by a DC corona charging device 105, and charging of the image forming cycle of the second color is carried out by an AC corona charging device 106 (e.g., JPB No. 36230/1991).

In such a color image forming apparatus, however, a toner layer exists on the image carrier in the image forming cycle of the second color or later, but if the charging is carried out in the state that the toner layer exists, the absolute value of the surface potential of the toner layer rises significantly due to the charge of the toner layer itself and the absolute value of the surface potential of the image carrier itself holding the toner layer thereon is relatively decreased.

Therefore, for example, in a type of adopting the reversal development as developing system, even if the exposure is carried out in the image forming cycle of the second color or later, technical problem is found in that it becomes difficult to secure sufficiently the difference between the surface potential of the image carrier and the potential of the exposed portion, that is, the latent image contrast potential, and corresponding to this, the upper layer toner is not developed sufficiently, which results in the cause of the color variation.

As means for solving such a technical problem, for example, technology is already provided where two DC corona charging devices are arranged continuously and the potential allocated to the image carrier is made large and the latent image contrast potential is raised (e.g., JPA No. 209274/1991).

In this connection, as shown in FIG. 18, technology is already provided where, for example, a DC power source 113 in the same polarity as the charged polarity is connected to a corona wire 112 of a first corona charging device 111, and on the other hand, a DC power source 116 in the opposite polarity to the charged polarity is connected to a corona wire 115 of a second corona charging device 114, and the absolute value of the surface potential of the image carrier 104 is charged to the charging potential required for the development or more by the first corona charging device 111 and then set to the charging potential previously set by supplying the reverse charge by the second corona charging device 114.

According to this type, charge injected by the first corona charging device 111 is more than that in a type using single charging device, and charge injected by the second corona charging device 114 mainly neutralizes the charge on the surface of the toner layer and reverses it.

Therefore according to the electric field produced by the toner layer itself, the charge injected by the first corona charging device 111 is apt to distribute much in the vicinity of the surface of the image carrier 104 and the potential allocated to the image carrier 104 is secured large, and the charge on the surface of the toner layer becomes that reversed to the charge on the surface of the image carrier 104 and corresponding to this, the toner on the surface of the toner layer is attracted to the side of the image carrier 104 electrostatically.

Consequently even if the thickness of the toner layer becomes large, the potential of the image carrier can be secured sufficiently large and corresponding to this, decrease of the contrast of the latent image potential in the color superposing can be suppressed.

However, when the second toner image is produced in superposing on the first toner image, for example, in the case of color character or color image, in the exposure process of the second image forming cycle, disadvantage is produced so that the first toner image is scattered in the surrounding of the second exposure region (toner scattering phenomenon) and sharpness of the image is deteriorated, and in the development process of the second image forming cycle, the first toner image is transferred into the second developing device (reversal development phenomenon) thereby technical problems such as the optical density deterioration, the color variation and the color mixing are produced.

These are caused by that the first toner image is scattered to the environment of the exposure region with high surface potential due to the discharge of the reverse charge by the second corona charging device and subjected to the reversal development due to bias of the developing roll of the second developing device.

SUMMARY OF THE INVENTION

In order to solve the above-mentioned technical problems in the prior art, an object of the present invention is to provide a color image forming apparatus where influence of rise of the absolute value of the surface potential of the toner layer occurring during the color superposing is reduced by a simple mechanism, and the reversal development is inhibited and the image having sufficient optical density and being clear and excellent in the chromaticness.

That is, the present invention as shown in FIG. 1, comprises an image carrier 1 with a sensitive medium formed on a conductive substrate, charging means 2 for charging the image carrier 1 in each color component image forming cycle, exposure means 3 for forming an electrostatic latent image corresponding to each color component image on the image carrier 1 in each color component image forming cycle, multi-color development means 4 for carrying out toner development of the electrostatic latent image corresponding to each color component image in each color component image forming cycle, and collective transfer means 5 for transferring collectively a plurality of color component toner images formed on the image carrier 1 to an image receptor 6, wherein the charging means 2 used in the image forming cycle of at least the second color or later is composed of a corona charging device having a discharge electrode 7 and a grid 8 with corona ion flow control voltage applied thereto, and the discharge electrode 7 is connected to an electrode power source 9 with at least AC voltage applied thereto and on the other hand, the grid 8 is connected to a grid power source 10 with at least AC voltage applied thereto, the AC voltage being at the same phase as that of the AC voltage applied to the discharge electrode 7, and the optimum conditions of the AC voltage from the grid power source 10 are newly set.

The optimum conditions of the AC voltage from the grid power source 10 used in the present invention are in that firstly, the frequency A of the AC voltage from the grid power source 10 is set to not less than 50 Hz and not more than 5 kHz, and that secondly, the peak-to-peak amplitude B of the AC voltage from the grid power source 10 is set to not less than 50 Vp-p and not more than 2 kVp-p. At least one of these conditions must be satisfied.

Such technical means may be applied to a type where the image carrier 1 is rotated one turn per each color component image forming cycle, or another type where it is rotated one turn per plural or all color component image forming cycles.

Also the exposure means 3 may be provided individually in each color component image forming cycle, but considering miniaturization and low cost, common use in plural or all image forming cycles is preferable.

Further the multi-color development means 4 may be provided individually in each color component, or may be a rotary type where a development unit holding each color component toner is arranged rotatably.

Still further, the collective transfer means 5 may be provided with at least function of transferring the toner images on the image carrier 1 to the image receptor 6, but in order to stabilize the transfer performance of the toner images, it is preferable that a charging device before transfer is used where toner images on the image carrier 1 are charged in the polarity aligned state, or that a separator is used where the image receptor 6 is separated from the image carrier 1 after the transfer process. In the mode of using these elements, these elements are included in the collective transfer means 5 of the present invention.

Also as the discharge electrode 7 of the charging means 2, a wire electrode, pin electrodes of various shapes such as sawtoothed shape or needle shape, or a creeping discharge electrode may be selected properly.

Further, as the AC voltage to be applied to the discharge electrode 7 and the grid 8 of the charging means 2, although sine wave is used usually, square wave, triangular wave or the like may be used, or otherwise, the AC voltage of different shapes may be applied to the discharge electrode 7 and the grid 8, for example, sine wave may be applied to the discharge electrode 7 and square wave may be applied to the grid respectively. Also the duty ratio may be varied in order to improve the charging capability.

Also it is arbitrary whether the DC voltage component is superposed on the discharge electrode 7 or not, but from the viewpoint of intending the miniaturization of the charging means, application of the DC voltage component is preferable.

This is because, if the DC voltage component of voltage to be applied to the discharge electrode 7 is close to zero, the known charging device slope characteristics indicating the charging capability are deteriorated, and in order to obtain the equivalent performance, the charging device of larger size is required.

However, in the mode where the image carrier power source 11 with the DC voltage component applied thereto is connected to the conductive substrate of the image carrier 1 for example, when voltage having the opposite polarity to and the same amount as the voltage applied to the discharge electrode 7 is used as the DC voltage component of the image carrier power source 11, the DC voltage component can be applied relatively to the discharge electrode 7 even if the DC voltage component of the electrode power source 9 is omitted.

Further in order to charge the image carrier 1 to the prescribed potential by the charging means 2, the grid power source 10 with the DC voltage superposed thereon is used usually so that the charging potential level of the image carrier 1 is included within the range of the voltage level applied to the grid 8.

However, the DC voltage component is not always required as the voltage from the grid power source 10, but, for example, in the mode where the image carrier power source 11 with the DC voltage component applied thereto is connected to the conductive substrate of the image carrier 1, when voltage having the opposite polarity to and the same amount as the DC voltage applied to the grid 8 is used as the DC voltage component of the image carrier power source 11, the DC voltage component can be applied relatively to the grid 8 even if the DC voltage component of the grid power source 10 is omitted.

Still further, in the mode where the image carrier power source 11 with the DC voltage component applied thereto is connected to the collective substrate of the image carrier 1, if the DC voltage component has the opposite polarity to and the same amount as the transfer voltage, when the transfer electrode of the collective transfer means 5 is grounded, the transfer voltage can be applied relatively to the transfer electrode even if the transfer voltage power source of the collective transfer means 5 is omitted.

According to the technical means as above described, the charging, the exposure and the development are repeated in each color component image forming cycle on an image carrier 1, and a plurality of toner images are formed on the image carrier 1 and then transferred collectively to an image receptor 6.

In such an image forming cycle, since a toner layer is already formed on the image carrier 1 in the image forming cycle of the second color or later, if the toner layer is charged by the charging means 2, the charge possessed by the toner itself will remain in the toner layer part even if the residual charge on the image carrier 1 is removed by the discharging means.

The charging means 2 produces the positive charged ions (positive charge) and the negative charged ions (negative charge) from the discharge electrode 7, and leads the positive charge or the negative charge to the side of the image carrier 1 in response to the potential difference between the grid 8 and the image carrier 1.

Then since the AC voltage in nearly the same phase as that of the AC voltage applied to the discharge electrode 7 is applied to the grid 8, when the discharge electrode 7 becomes the negative polarity, the grid 8 is biased to the negative polarity side in comparison with the DC voltage component by the grid power source 10 or the image carrier power source 11, and the image carrier 1 including the toner layer is charged to the negative polarity significantly. On the other hand, when the discharge electrode 7 becomes the positive polarity, the grid 8 is biased to the positive polarity side in comparison with the DC voltage component, and the surface potential of the image carrier 1 including the toner layer charged to the negative polarity significantly is lowered actively due to the discharge of the positive charge.

By repetition of this process, the charged potential of the toner layer part is suppressed to small value, and the surface potential of the image carrier 1 including the toner layer is charged nearly uniformly to the prescribed charged potential.

Consequently, the potential allocated to the surface potential of the image carrier 1 with the toner layer held thereon becomes large relatively, and corresponding to this, the latent image contrast potential due to the exposure is secured to sufficiently large value.

Further since the charges of the positive polarity and the negative polarity generated from the discharge electrode 7 of the charging means 2 are repeatedly led to the uppermost layer of the toner layer on the image carrier 1, it is avoided that the uppermost layer of the toner layer entirely becomes the opposite polarity.

Particularly in the present invention, the frequency A of the AC voltage from the grid power source 10 is set to not less than 50 Hz and not more than 3.5 kHz.

Here, in the lower limit of the frequency A of the AC voltage, such region is excluded that the toner layer potential rises rapidly and the charging unevenness is conspicuous, and on the other hand, in the upper limit thereof, such region is excluded that the toner layer potential rises gradually and the toner layer is lacking in the discharging effect. This is based on the experimental results of the embodiments as described later.

A definite time is required in order that the image carrier passes through the region of the grid 8, and during this passage time, the toner layer is charged by the positive charge and the negative charge repeatedly sufficiently many times determined by the drive frequency of AC power source applied to the grid 8. In order that the charged amount of the toner layer charged by this repetition becomes the negative charge as a whole, the AC power source applied to the grid 8 has the center potential so as to take the negative potential as a whole. Therefore the negative charge discharged from the charging device becomes more than the positive charge. While the toner layer passes through the grid, it is demagnetized repeatedly by the charge of the opposite polarity, and moreover since the passing of the grid is finished at a moment, the toner layer surface is maintained to the state of the negative charge at the time of passage finishing.

Also in the present invention, the peak-to-peak amplitude B of the AC voltage from the grid power source 10 is set to not less than 50 Vp-p and not more than 2 kVp-p.

Here, in the lower limit of the peak-to-peak amplitude B of the AC voltage, such region is excluded that the toner layer potential rises rapidly and the toner layer is lacking in the discharging effect, and on the other hand, in the upper limit thereof, such region is excluded that scattering of toners from the toner image already formed on the image carrier 1 is conspicuous. This is based on the experimental results of the embodiments as described later.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DESCRIPTION OF THE PREFERRED EMBODIMENTS

The present invention will be described in detail based on the embodiments shown in the accompanying drawings as follows.

Embodiment 1

Figure 1:
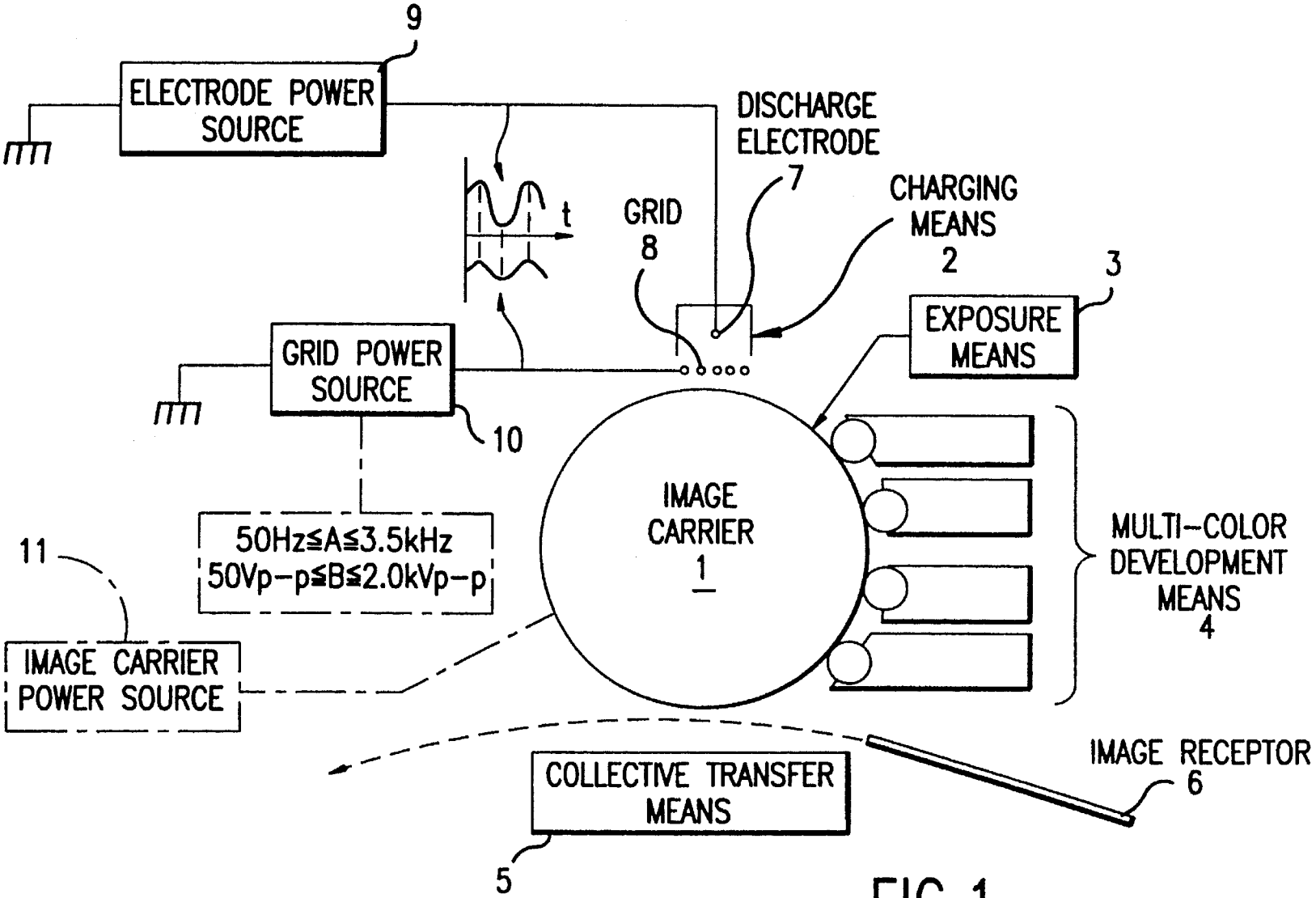
FIG. 1 is an explanation diagram showing configuration of a color image forming apparatus according to the invention.
Figure 2:
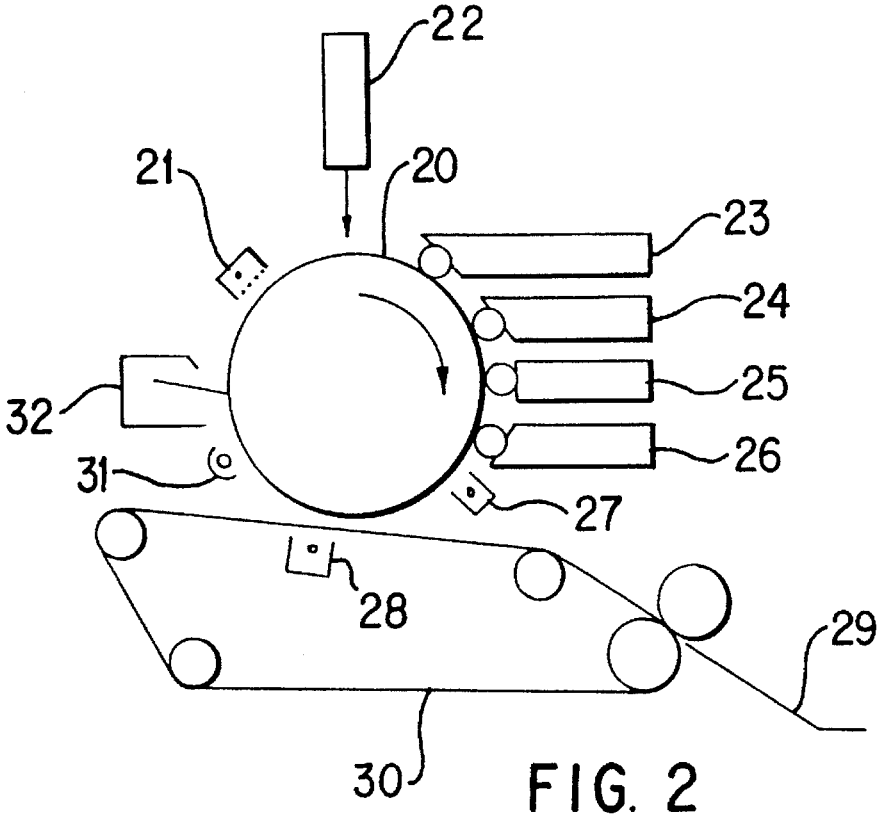
FIG. 2 is an explanation diagram showing configuration of a color image forming apparatus according to the first embodiment.

FIG. 2 shows the embodiment 1 of a color image forming apparatus to which the invention is applied.

In FIG. 2, numeral 20 designates a photosensitive drum as an image carrier composed of an organic photosensitive body having a surface coat layer of insulating property for example, numeral 21 designates a charging device composed of scorotron for charging the photosensitive drum 20, numeral 22 designates a laser scanning unit such as a semiconductor laser for writing an electrostatic latent image of each color component (yellow, magenta, cyan, black in this embodiment), numerals 23 to 26 designate developing devices for developing (reversal development), for example, an exposure portion of a latent image formed on the photosensitive body 20 in each color component image forming cycle holing each color toner of yellow, magenta, cyan, black respectively, numeral 27 designates a pretransfer charging device composed of scorotron for example, for controlling the charging amount before transfer of each toner image formed on the photosensitive drum 20, numeral 28 designates a transferring charging device composed of scorotron for example, for transferring collectively each toner image on the photosensitive drum 20 to a recording paper 29 as an image receptor, numeral 30 designates a dielectric transfer belt for holding and conveying the recording paper 29 to the transfer position, numeral 31 designates an optical discharging device for removing the residual charge on the photosensitive drum 20, and numeral 32 designates a cleaner of blade cleaning system for example, for removing toners on the photosensitive drum 20.

Figure 3:
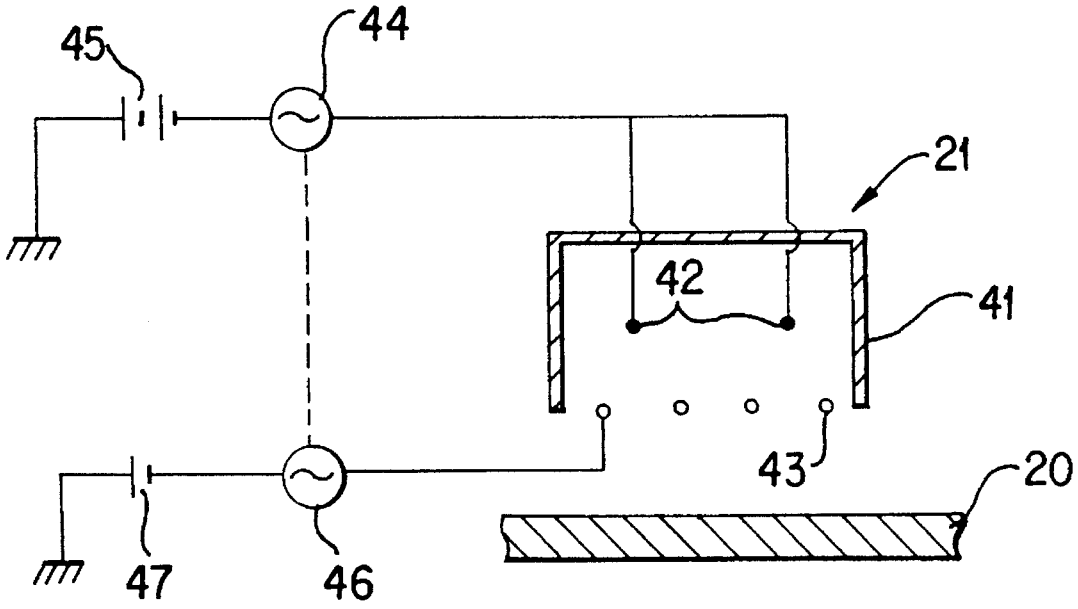
FIG. 3 is an explanation diagram showing details of a charging device according to the first embodiment.

In this embodiment, the charging device 21 composed of the scorotron, as shown in FIG. 3 for example, is provided with a shield 41 in channel shape of U-like cross-section opened in opposition to the surface of the photosensitive drum 20, and a discharge wire 42 (a pair in this embodiment) is stretched within the shield 41, and further a grid 43 for corona ion flow control is arranged in the opened surface of the shield 41.

Particularly in this embodiment, for example, an AC power source 44 of sine waveform of 12 kVp-p, 40 Hz and a DC power source 45 of −1 kV are connected in series to the discharge wire 42.

On the other hand, an AC power source 46 of 500 Vp-p in the same phase as that of the AC voltage to the discharge wire 42 and a DC power source 47 of −600 V for DC bias are connected in series to the grid 43.

Next, operation of the color image forming apparatus according to this embodiment will be described.

First, as the first image forming cycle, the photosensitive drum 20 is discharged by the optical discharging device 31 and a cleaning blade (not shown) of the cleaner 32 touches the photosensitive drum 20 for cleaning.

Next, the AC voltage of 12 kVp-p, 400 Hz is applied to the discharge wire 42 of the charging device 21, and the AC voltage of 500 Vp-p in the same phase as that applied to the discharge wire 42 with the DC bias −600 V superposed thereon is applied to the grid 43 thereby the photosensitive drum 20 is charged uniformly.

And then, the first image exposure is applied by the laser scanning unit 22 and the electrostatic latent image of the yellow image is formed. The developing bias of −550 V for example is applied to the yellow developing device 23, thereby yellow toners adhere onto the photosensitive drum 20.

Next, the cleaner 32 is retracted from the photosensitive drum 20 and set to the non-operation state, and the second image forming cycle starts.

The charging device 21 is operated in the same condition as that of the first image forming cycle, and the photosensitive drum is charged uniformly. And then the second image exposure is applied by the laser scanning unit 22, and the developing bias of −550 V is applied to the magenta developing device 24 thereby magenta toners adhere onto the photosensitive drum 20.

Further as the third image forming cycle and the fourth image forming cycle, similar process to that of the second image forming cycle is repeated thereby images of cyan and black are formed. And then the charging amount required for the transfer is supplied to each toner by the pretransfer charging device 27. Finally the toners adhering to the photosensitive drum 20 are transferred collectively by the transferring charging device 28 to the recording paper 29 conveyed by the transfer belt 30.

Further the recording paper 29 separated from the photosensitive drum 20 passes through a fixing device (not shown) thereby each color component toner image on the recording paper 20 is fixed. On the other hand, the residual toner and the residual charge (hysteresis of charging) on the photosensitive drum 20 are removed consecutively by the cleaner 32 and the optical discharging device 32 thereby the image forming cycle is finished.

In such an image forming cycle, action of the charging device 21 will be described based on FIGS. 4 and 5.

Figure 4:
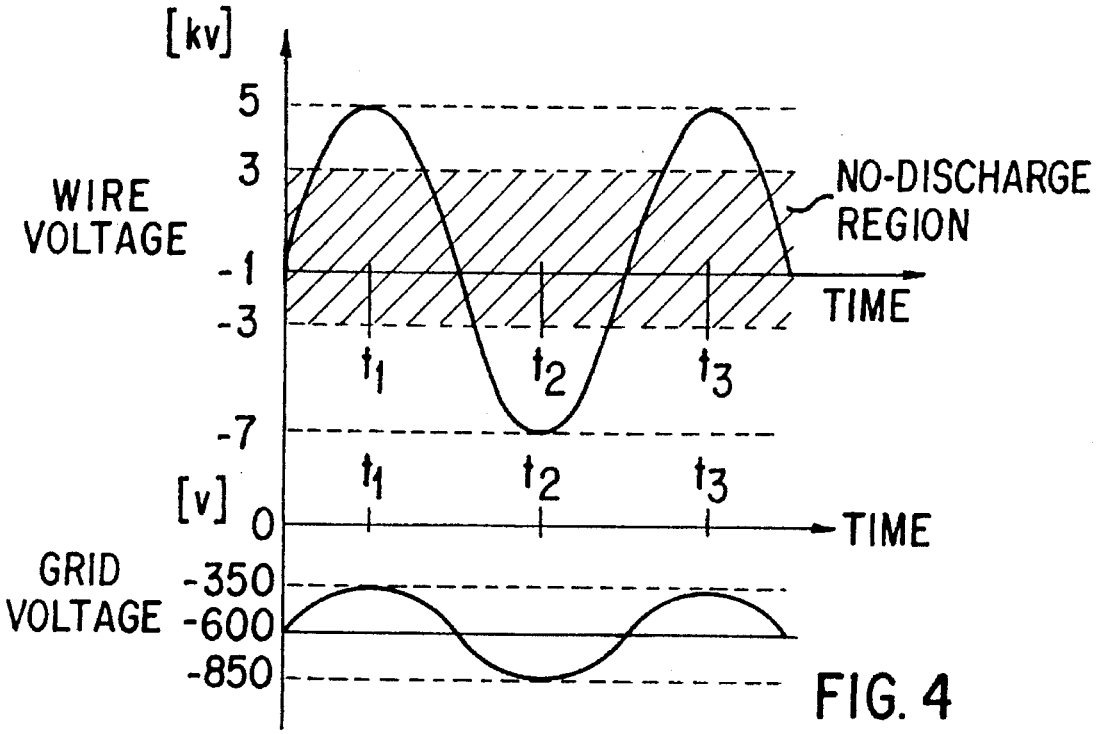
FIG. 4 is an explanation diagram showing applied voltage to a discharge wire and a grid of a charging device according to the first embodiment.

In FIG. 4, charges of the positive polarity and the negative polarity in nearly the same amount are discharged by the AC power source 44 of 12 kVp-p connected to the discharge wire 42 of the charging device 21. In the voltage of ±3 kV or less, however, since the electric field intensity on the polarity of the discharge wire 42 is small, the discharge is not produced.

On the other hand, the AC voltage of 500 Vp-p with the DC bias −600 V as the center is applied to the grid 43 of the changing device 21 in the same phase (synchronized) as that of the AC voltage applied to the discharge wire 42.

Figure 5:
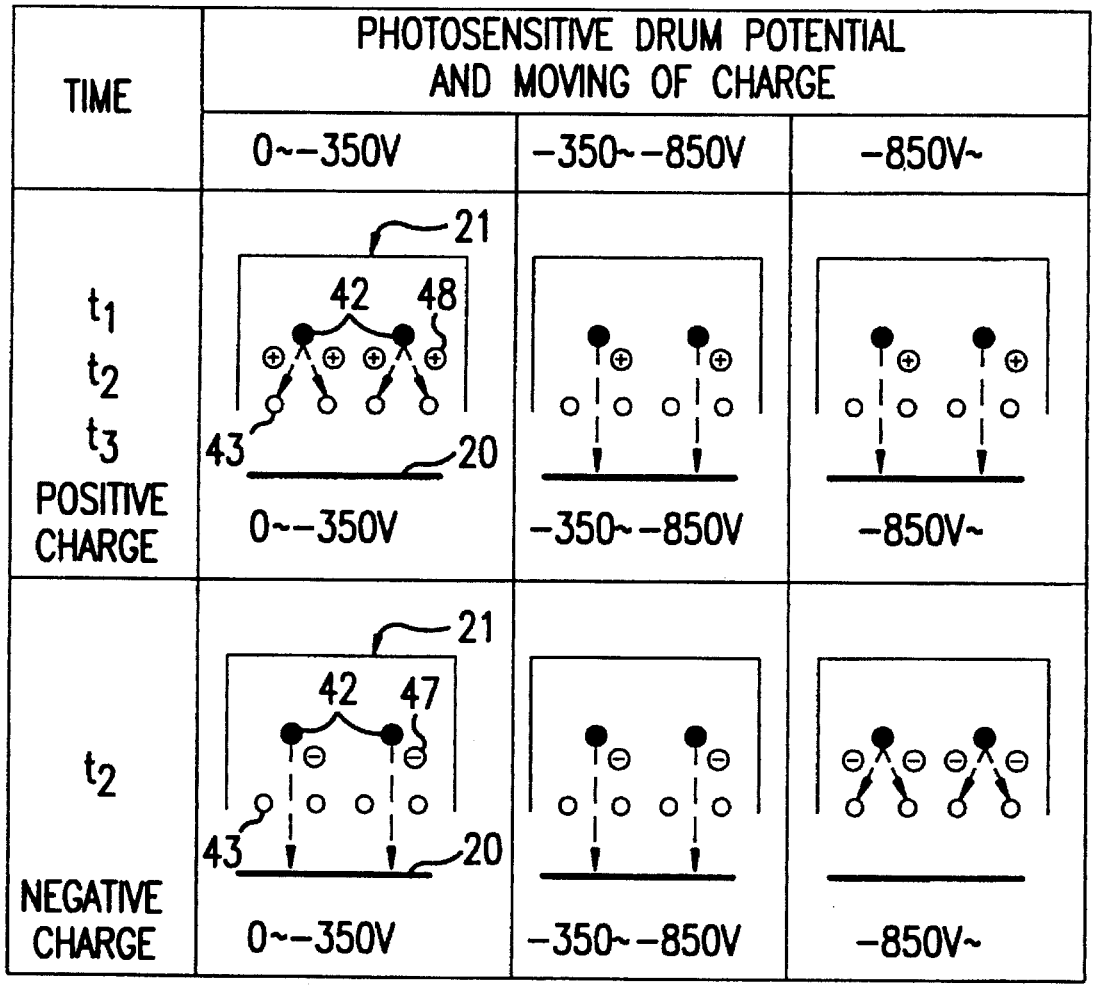
FIG. 5 is an explanation diagram showing operation state of a charging device according to the first embodiment.

Under such conditions, as shown in $t_2$ of FIG. 5 for example, when the discharge wire 42 is at the negative polarity, the applied voltage of the grid 43 is biased to the side of the negative polarity in comparison with the DC bias, and while the potential of the surface part (including the toner layer) of the photosensitive drum 20 between 0 and −850 V, the negative charge 47 is led much to the surface part of the photosensitive drum 20.

On the other hand, as shown in $t_1$ or $t_3$ of FIG. 5 for example, when the discharge wire 42 is at the positive polarity, the applied voltage of the grid 43 is biased to the side of the positive polarity in comparison with the DC bias, and while the potential of the surface part of the photosensitive drum 20 is biased to the side of the negative polarity in comparison with −350 V, the positive charge 48 is led to the surface part of the photosensitive drum 20.

By this repetition, the potential of the toner layer on the photosensitive drum 20 is suppressed to sufficiently low value due to the neutralization of the negative charge 47 and the positive charge 48, and the potential of the surface part of the photosensitive drum 20 is charged nearly uniformly to the DC bias −600 V of the grid 43.

Figure 6:
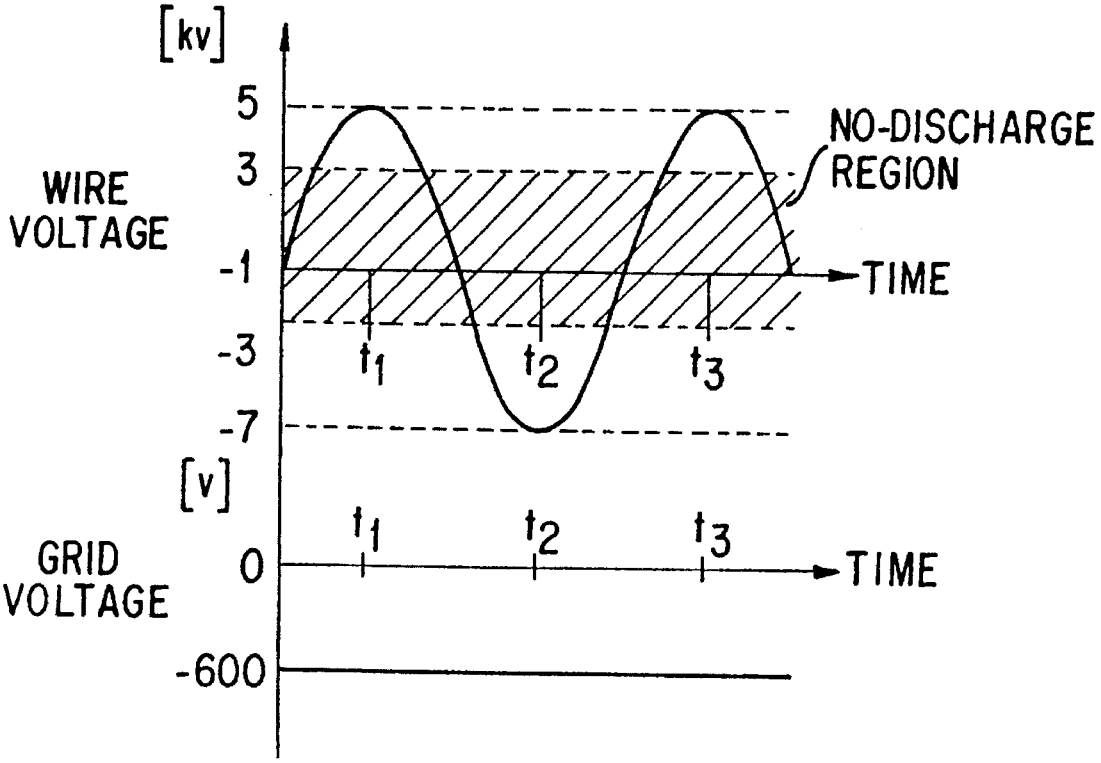
FIG. 6 is an explanation diagram showing an example of varying applied voltage to a grid of a charging device according to the first embodiment.
Figure 7A:
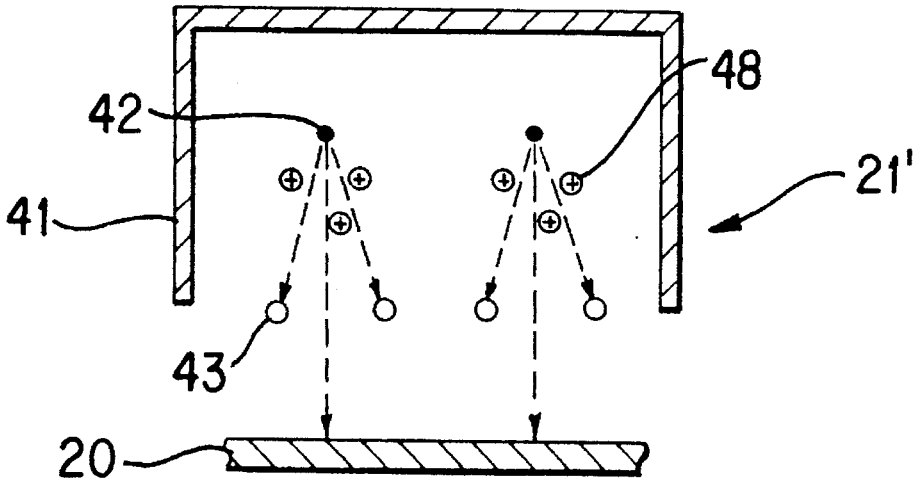
FIGS. 7A & 7B is an explanation diagram showing operation state of a charging device under condition of FIG. 6.
Figure 7B:
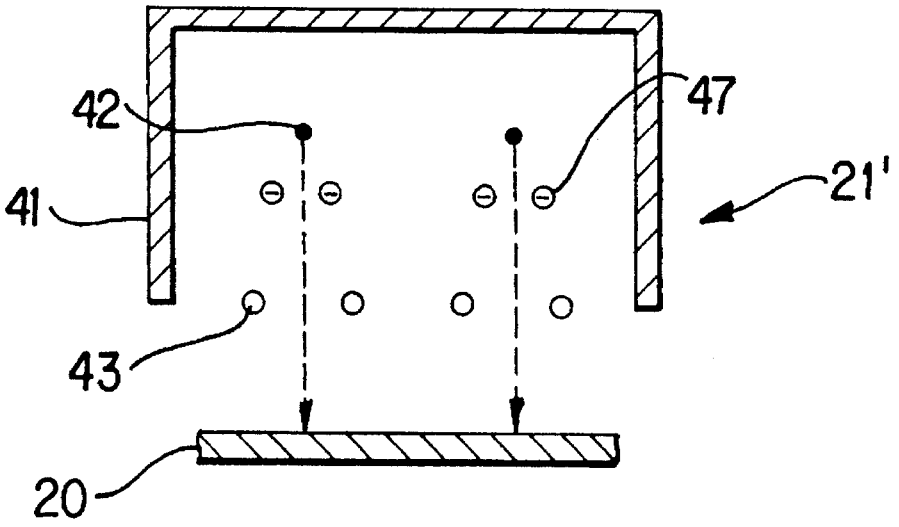

In order to evaluate the performance of the charging device 21 according to this embodiment, as shown in FIG. 6, when the application of the AC voltage to the grid 43 is stopped and the photosensitive drum 20 is charged by the charging device 21' to which only the DC bias (−600 V in this embodiment) is applied, before the potential of the surface part of the photosensitive drum 20 attains to −600 V, a part of the positive charge 48 produced from the discharge wire 43 is led to the surface part of the photosensitive drum 20 but most of the positive charge is trapped by the grid 43 (refer to FIG. 7(*a*)), and the negative charge 47 produced from the discharge wire 43 is mainly led to the surface part of the photosensitive drum 20 (refer to FIG. 7(*b*)).

Consequently in this type, since much negative charge 48 is led in concentration to the surface part of the photosensitive drum 20, the potential of the toner layer of the photosensitive drum 20 becomes high.

Next, the performance of the color image forming apparatus according to this embodiment will be compared with each of comparison examples 1 to 3.

Figure 16:
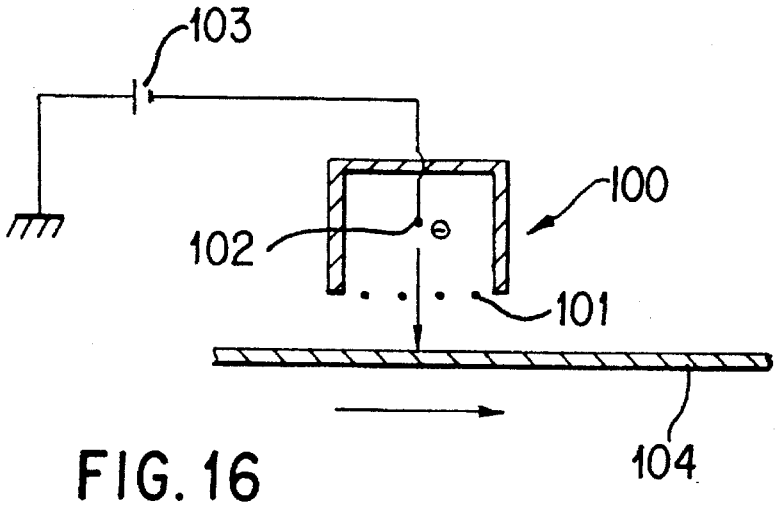
FIG. 16 is an explanation diagram showing an example of a charging device used in a color image forming apparatus in the prior art.
Figure 17:
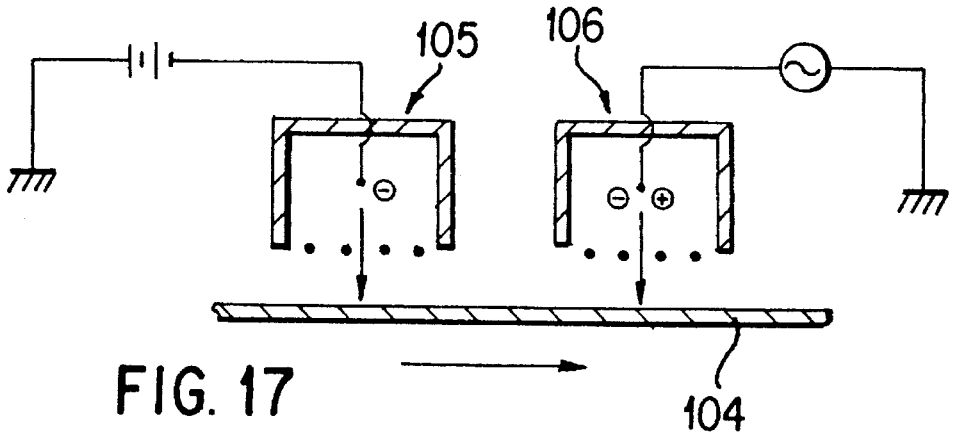
FIG. 17 is an explanation diagram showing another example of a charging device used in a color image forming apparatus in the prior art.
Figure 18:
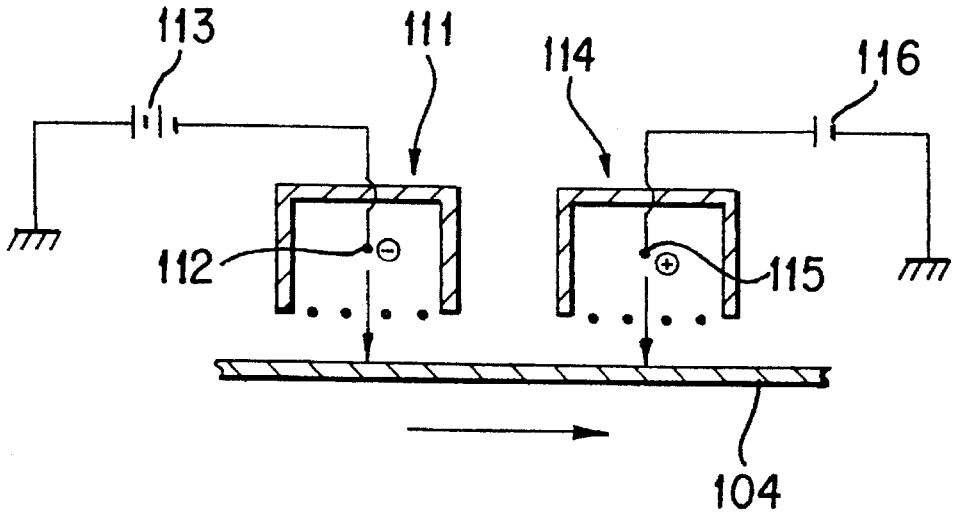
FIG. 18 is an explanation diagram showing still another example of a charging device used in a color image forming apparatus in the prior art.

Here, in the comparison example 1, the charging device 100 shown in FIG. 16 is used in place of the charging device 21 according to this embodiment, and in the comparison example 2, the charging devices 105, 106 shown in FIG. 17 are used in place of the charging device 21 according to this embodiment, and in the comparison example 3, the charging devices 111, 114 shown in FIG. 18 are used in place of the charging device 21 according to this embodiment.

Figure 8:
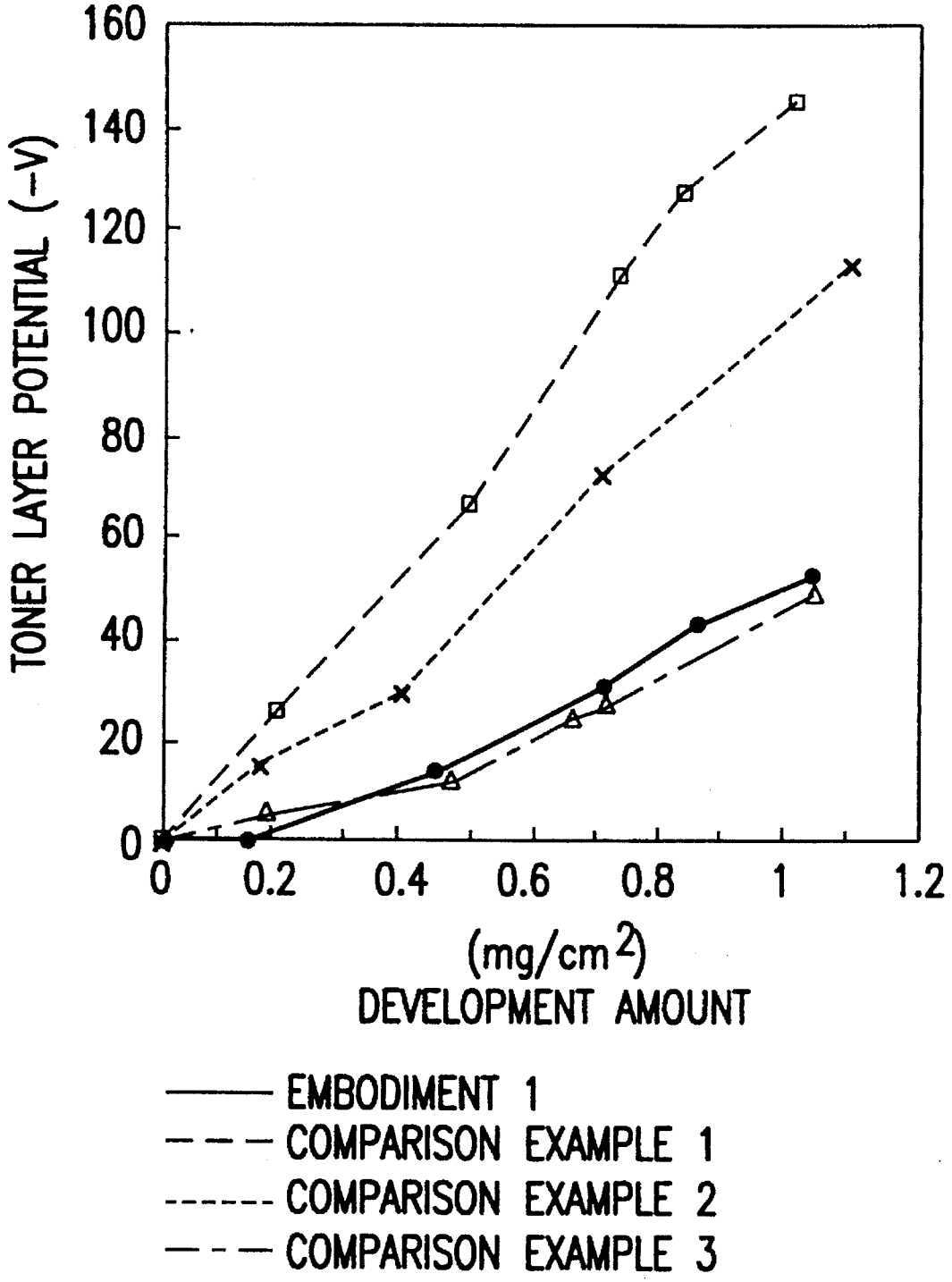
FIG. 8 is a graph showing relation between development amount and toner layer potential in the first embodiment and comparison examples 1 to 3.

In this embodiment and each of the comparison examples 1 to 3, relation between the development amount (corresponding to the toner layer thickness) and the toner layer potential is shown in FIG. 8, and evaluation regarding the color variation due to the toner layer potential and the toner scattering phenomenon and the reversal development phenomenon due to the reversal charging of the toner layer are shown in following Table 1 (o: no generating, x: generating).

In addition, the toner layer potential in FIG. 8 is obtained in that recharging is carried out after one color development and then the potential on the toner layer during the whole surface exposure is measured.

TABLE 1

| | color variation | by reversal charging of 1st toner layer | |
|---|---|---|---|
| | by 1st toner layer potential | toner scattering | reversal development |
| Embodiment | O | O | O |
| Comparison example 1 | x | O | O |
| Comparison example 2 | x | O | O |
| Comparison example 3 | O | x | x |

First in this embodiment, as shown by solid line in FIG. 8, even if the development amount (corresponding to the toner layer thickness) is increased, the toner layer potential does not rise so much. As a result, the absolute value of the surface potential of the photosensitive drum 20 with the toner layer held thereon is secured to relatively high value, and corresponding to this, the latent image contrast potential due to the exposure can be secured to sufficiently large value and the development of the toners on the upper layer is carried out securely and the color variation phenomenon due to the toner layer potential is avoided effectively.

Further in the uppermost layer of the toner layer, since the negative charge and the positive charge are united together, such state is avoided that the uppermost layer of the toner layer is charged reversely with respect to the toner polarity, and the toner scattering phenomenon and the reversal development phenomenon due to the toner layer were not at all seen.

On the contrary, in the comparison example 1 as shown by broken line in FIG. 8, if the development amount is increased, since the toner layer potential rises considerably, the absolute value of the surface potential of the photosensitive drum 20 with the toner layer held thereon becomes relatively small, and corresponding to this, the latent image contrast potential due to the exposure cannot be secured to sufficiently large value and the color variation phenomenon attendant on the rise of the toner layer potential is produced. However, since the reversal charging of the toner layer is not produced, the toner scattering phenomenon and the reversal development phenomenon due to the reversal charging of the toner layer were not at all seen.

Also in the comparison example 2, as shown by dotted line in FIG. 8, if the development amount is increased, since the toner layer potential rises although in little amount in comparison with the comparison example 1 (In the comparison example 2, the charge of the opposite polarity is partly led to the side of the photosensitive drum 20, and corresponding to this, the rise rate of the toner layer potential is little in comparison with the comparison example 1.), the absolute value of the surface potential of the photosensitive drum 20 with the toner layer held thereon becomes relatively small, and corresponding to this, the latent image contrast potential due to the exposure cannot be secured to sufficiently large value and the color variation phenomenon attendant on the rise of the toner layer potential is produced. However, since the reversal charging of the toner layer is not produced, the toner scattering phenomenon and the reversal development phenomenon due to the reversal charging of the toner layer were not at all seen.

Further in the comparison example 3, as shown by dash-and-dot line in FIG. 8, even if the development amount is increased, the toner layer potential does not rise so much. As a result, the absolute value of the surface potential of the photosensitive drum 20 with the toner layer held thereon is secured to relatively high value, and corresponding to this, the latent image contrast potential due to the exposure can be secured to sufficiently large value and the development of toners on the upper layer is carried out securely and the color variation phenomenon due to the toner layer potential is avoided effectively.

However, in the comparison example 3, since the uppermost layer of the toner layer is charged in the opposite polarity to the toner polarity, the toner scattering phenomenon and the reversal development due to the reversal charging of the toner layer were not seen.

Figure 9:
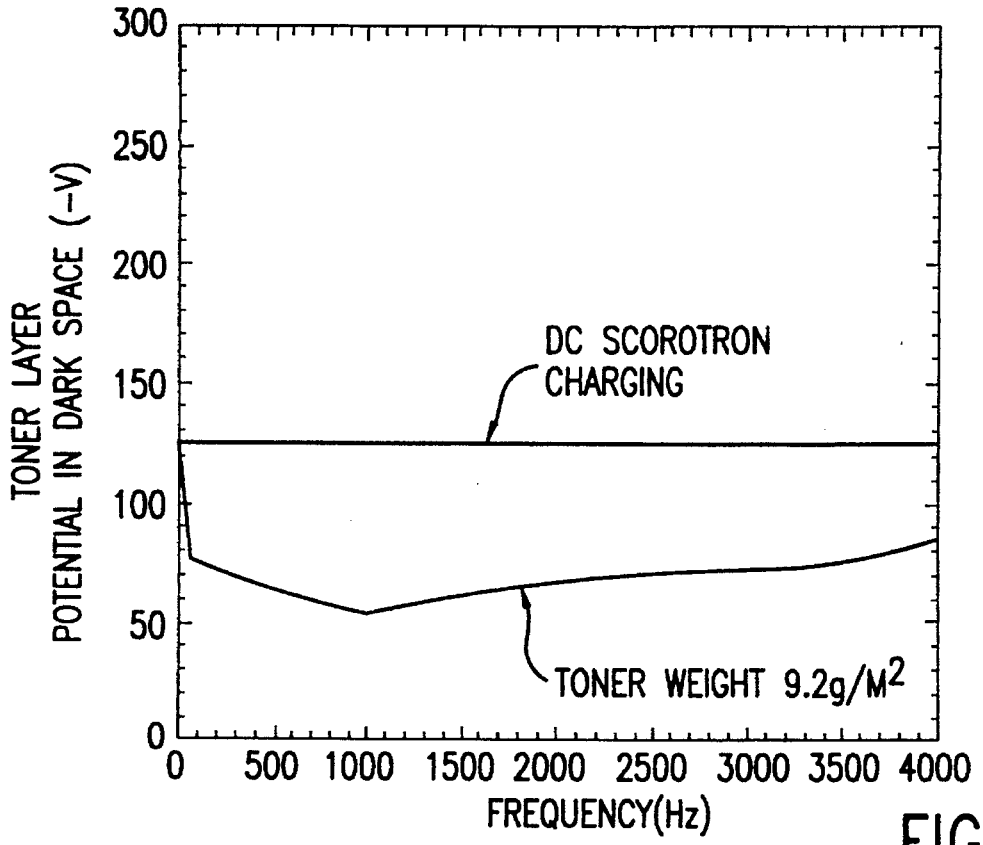
FIG. 9 is a graph showing relation between frequency of AC voltage applied to a grid of a charging device used in the first embodiment and toner layer potential in dark space.

Also in this embodiment, relation of the toner layer potential to the frequency of the AC voltage applied to the grid 43 of the charging device 21 is shown in FIG. 9.

According to FIG. 9, it is seen that the toner layer potential has the minimum value to the frequency of the applied AC voltage (nearly 1 kHz) and rises rapidly when the frequency is less than 50 Hz, and also it begins to rise gradually when the frequency exceeds nearly 3.0 kHz, and further the color reproduction of the multiple toner parts is insufficient when the frequency exceeds 35 kHz.

In addition, "DC scorotron charging" in FIG. 9 indicates the toner layer potential when the same scorotron DC voltage is applied.

Also the investigation result of the charging unevenness and the discharging effect of the toner layer is as shown in following Table 2.

TABLE 2

| frequency/Hz | <50 | 50 3500 | 3500< |
|---|---|---|---|
| charging unevenness | x | O | O |
| discharging effect | O | O | x |

According to Table 2, when the frequency becomes less than 50 Hz, the charging unevenness caused by the AC charging becomes conspicuous. The charging unevenness is dissolved as the frequency is raised. On the other hand, regarding the discharging effect of the toner layer, since the toner layer potential is lacking in the discharging effect and the color reproduction is affected when the frequency exceeds 3.5 kHz as above described, the frequency is preferably 3.5 kHz or less.

Saying from the experimental results, it is more preferable that the frequency is in the range from 100 Hz to 2.0 kHz from the viewpoint that the toner layer potential can be more reduced.

When the frequency is high, the power source inevitably becomes large size, and also from this meaning, the above-mentioned frequency range is preferable in order to supply the charging means of low cost.

Figure 10:
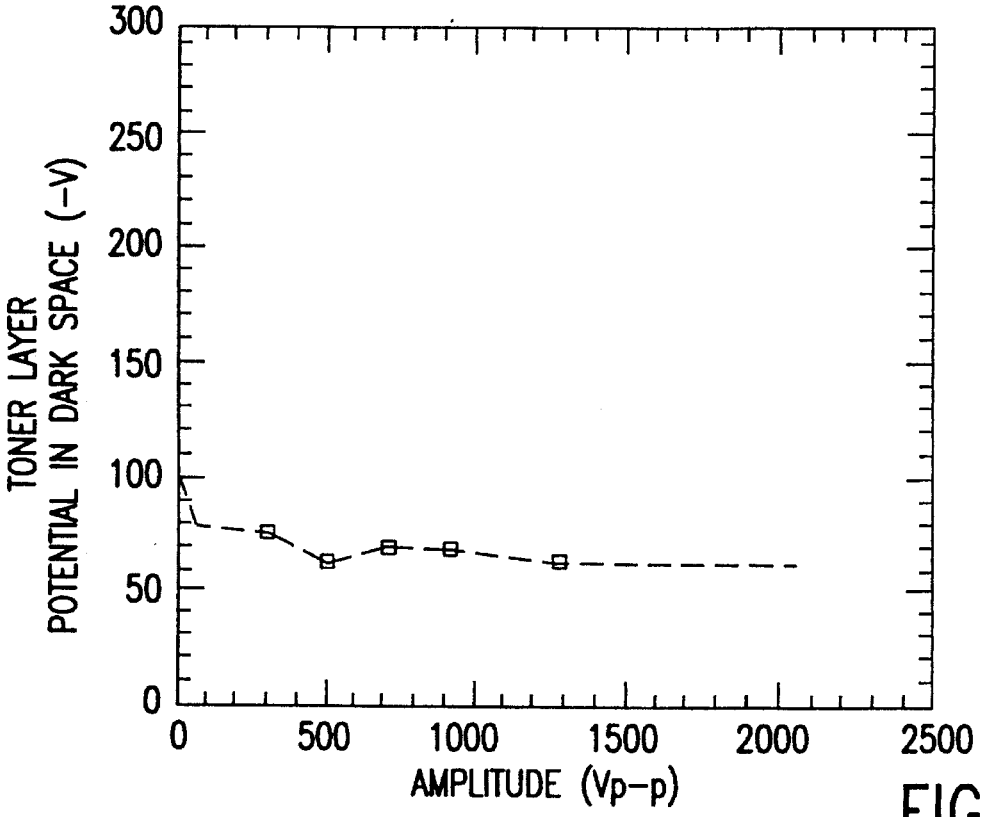
FIG. 10 is a graph showing relation between peak-to-peak amplitude of AC voltage applied to a grid of a charging device used in the first embodiment and toner layer potential in dark space.

Also in this embodiment, relation of the toner layer potential to the peak-to-peak amplitude (Vp-p) of the AC voltage component of 400 Hz applied to the grid 43 of the charging device 21 is shown in FIG. 10.

According to FIG. 10, it is seen that the toner layer potential rises rapidly when the amplitude (Vp-p) is less than 50 V, and it begins to fall as the amplitude is increased, and further it becomes nearly constant when the amplitude exceeds nearly 50 V.

Further the investigation result of the scattering of toners already formed on the photosensitive drum 20 and the discharging effect of the toner layer is as shown in following Table 3.

TABLE 3

| amplitude/Vp-p | <50 | 50 2000 | 2000< |
|---|---|---|---|
| toner scattering | none | none | generating |
| discharging effect | x | ○ | ○ |

According to Table 3, when the amplitude (Vp-p) becomes higher than 2 kV, the scattering of toners becomes conspicuous. The scattering of toners is dissolved by lowering the amplitude. On the other hand, regarding the discharging effect of the toner layer potential, as above described, it is seen that the toner layer potential rises rapidly when the amplitude is less than 50 V, and the toner layer potential is lacking in the discharging effect and the color reproduction.

Thus the good result is obtained when the amplitude (Vp-p) is in range from 50 V to 2 kV. More preferably, the better result is obtained when the amplitude is in range from 200 V to 1 kV.

When the amplitude is large, the power source inevitably becomes large size, and also from this meaning, the above-mentioned amplitude range is preferable in order to supply the charging means of low cost.

Further in this embodiment, since the DC voltage component is superposed on the discharge wire 42, the charging device slope characteristics indicating the charging capability are held good. Therefore in the case of a type that the DC voltage component is nearly zero or zero, corresponding to the deterioration of the charging device slope characteristics, the apparatus of large size is necessary but the charging performance is maintained without making the changing device 21 large size.

Embodiment 2

Figure 11:
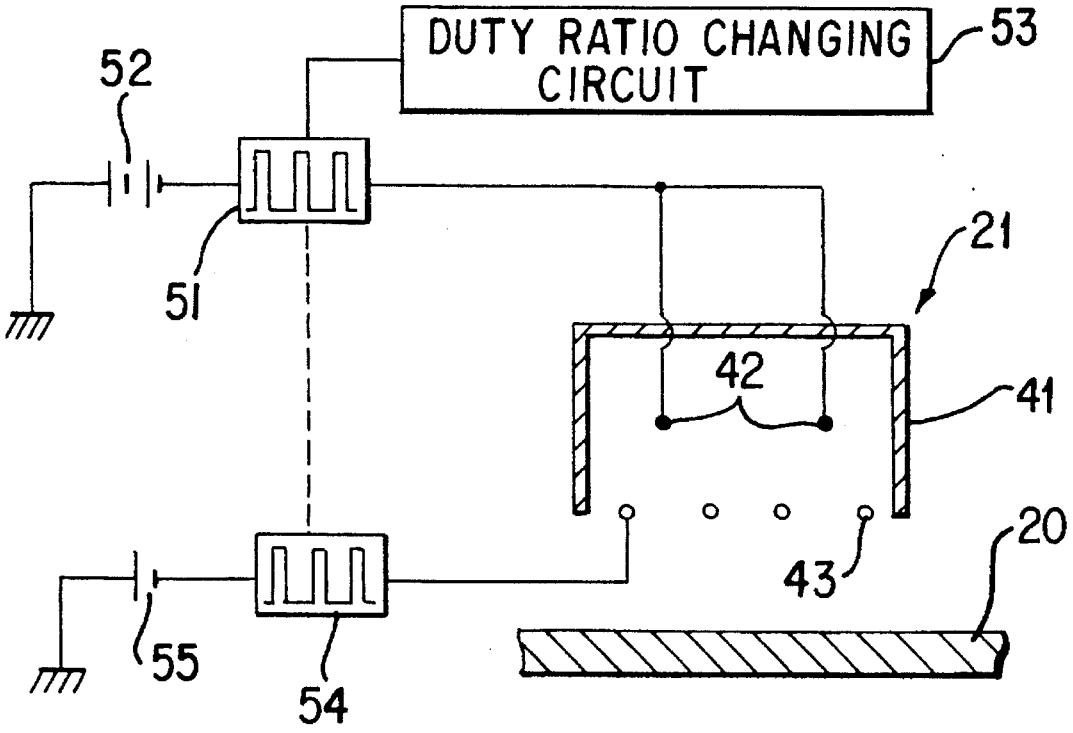
FIG. 11 is an explanation diagram showing details of a charging device used in a color image forming apparatus according to the second embodiment.

A charging device 21 used in a color image forming apparatus according to the embodiment 2 is shown in FIG. 11.

In FIG. 11, the basic configuration of the charging device 21 is nearly similar to that in the embodiment 1, but being different from the embodiment 1, an AC power source 51 applying AC voltage of square waveform to a discharge wire 42 and a DC power source 52 applying prescribed DC voltage component thereto are provided. The AC power source 51 is provided with a duty ratio changing circuit 53, which sets the duty ratio of the AC voltage so that, for example, in each color component image forming cycle, the same polarity side and the opposite polarity side to the charging polarity of the photosensitive drum 20 become the same time.

In addition, in this embodiment, in similar manner to the embodiment 1, an AC power source (AC voltage source of square waveform in this embodiment) 54 in the same phase as that of the AC voltage to the discharge wire 42 and a DC power source 55 applying the DC bias corresponding to, for example, the charging potential of the photosensitive drum 20 are connected in series to a grid 43.

Consequently in this embodiment, the duty ratio of the AC voltage is suitably adjusted, thereby fine adjustment of balance of amount of the positive charge and the negative charge produced from the discharge wire 42 becomes easy and the discharging effect of the toner layer potential can be realized more simply.

Also in this embodiment, for example, in the duty ratio changing circuit 48, the duty ratio of the AC voltage can be set so that in the image forming cycle of the first color, the same polarity side to the charging polarity of the photosensitive drum 20 becomes a long time and the opposite polarity side becomes a short time, and the duty ratio of the AC voltage can be set so that in the image forming cycle of the second color or later, the same polarity side and the opposite polarity side to the charging polarity of the photosensitive drum 20 becomes the same time.

In this case, in the image forming cycle of the second color or later, similar action to that as above described is effected, but in the image forming cycle of the first color, since the voltage in the same polarity to the charging polarity of the photosensitive drum 20 is applied to the discharge wire 42 for a long time, the charge in the same polarity of the photosensitive drum 20 is produced much from the discharge wire 42 and then led to the side of the photosensitive drum 20 thereby the initial charging efficiency to the photosensitive drum 20 in the image forming cycle of the first color becomes high.

Embodiment 3

Figure 12:
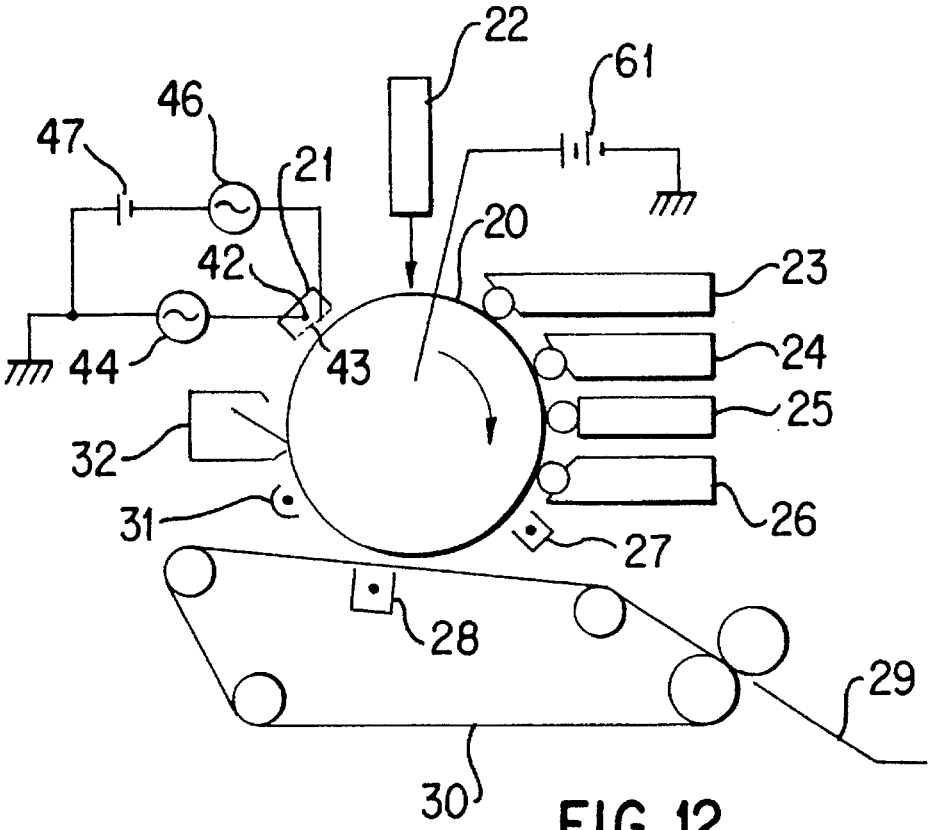
FIG. 12 is an explanation diagram showing configuration of a color image forming apparatus according to the third embodiment.

FIG. 12 shows the embodiment 3 of a color image forming apparatus according to the present invention. Similar components to those in the embodiment 1 are designated by similar numerals to those in the embodiment 1, and the detailed description shall be omitted.

In FIG. 12, the color image forming apparatus according to this embodiment is nearly similar to that in the embodiment 1, but being different from the embodiment 1, only an AC power source 44 of sine waveform of 12 kVp-p, 400 Hz is connected to a discharge wire 42 of a charging device 21, and an AC power source 46 of 500 Vp-p, 400 Hz in the same phase as that of the AC voltage of the discharge wire 42 and a DC power source 47 of the DC bias +100 V are connected to a grid 43.

Also a photosensitive drum 20 is constituted in that an optical conductive sensitive layer is provided on a conductive substrate such as aluminum, and a DC power source 61 of +700 V for example is connected to the conductive substrate of the photosensitive drum 20 and DC component of developing bias of developing devices 23 to 26 of each color is set to +150 V.

Next, operation of the color image forming apparatus according to this embodiment will be described.

First, as the first image forming cycle, the photosensitive drum 20 is discharged by an optical discharging device 31 and a cleaning blade (not shown) of a cleaner 32 touches the photosensitive drum 20 for cleaning.

Next, the AC voltage of 12 kVp-p, 400 Hz is applied to the discharge wire 42 of the charging device 21, and the AC voltage of 500 Vp-p in the same phase as that of the discharge wire 42 with the DC bias +100 V (corresponding to {the charging potential −600 V of the photosensitive drum 20}+{the conductive substrate potential +700 V of the photosensitive drum 20}) superposed thereon is applied to the grid 43 thereby the photosensitive drum 20 is charged uniformly.

And then the first image exposure is carried out by a laser scanning unit 22 and an electrostatic latent image of yellow image is formed. Developing bias of 150 V for example (corresponding to {the developing bias −550 V used in the embodiment 1}+{the conductive substrate potential +700 V of the photosensitive drum 20}) is applied to the yellow developing device 23 and yellow toners adhere onto the photosensitive drum 20.

Next, the cleaner 32 is retracted from the photosensitive drum 20 and set to the non-operation state, and process enters the second image forming cycle.

The charging device 21 is operated in the same condition as that of the first image forming cycle, and the photosensitive drum 20 is charged uniformly. And then the second image exposure is carried out by the laser scanning unit 22 and an electrostatic latent image of magenta image is formed, and developing bias of +150 V (−550 V+700 V) is applied to the magenta developing device 24, and magenta toners adhere onto the photosensitive drum 20.

Further as the third image forming cycle and the fourth image forming cycle, similar process to that of the second image forming cycle is repeated, and images of cyan and black are formed. And then the charging amount required for transfer is supplied to each toner by a pretransfer charging device 27. Finally the toners adhering to the photosensitive drum 20 are transferred collectively by a transfer charging device 28 to a recording paper 29 conveyed by a transfer belt 30.

Further the recording paper 29 separated from the photosensitive drum 20 passes through a fixing device (not shown) thereby each color component toner image on the recording paper 29 is fixed. On the other hand, the residual toners and the residual charge (hysteresis of charging) on the photosensitive drum 20 are removed consecutively by the cleaner 32 and the optical discharging device 31 thereby the image forming cycle is finished.

According to this embodiment, in similar manner to the embodiment 1, it is confirmed that the rise of the toner layer potential, the scattering of toners in the lower layer and the transfer of the toner image into the developing device can be prevented effectively although these were problems in the prior art.

Particularly in this embodiment, since the DC voltage of +700 V is applied to the conductive substrate of the photosensitive drum 20, the DC voltage component of −700 V is superposed relatively even if the DC power source is not connected to the discharge wire 42, thereby the charging device slope characteristics are held good.

Since +100 V will suffice for the DC bias applied to the grid 43 and also +150 V will suffice for the developing bias applied to each of the developing devices 23 to 26, the DC power source capacity for these may be little.

Further in this embodiment, if the DC voltage applied to the conductive substrate of the photosensitive drum 20 cancels (0 V) the DC component of the developing bias or the grid DC voltage component of the charging device 21, also these DC power sources can be omitted and the low cost can be further intended.

Embodiment 4

Figure 13:
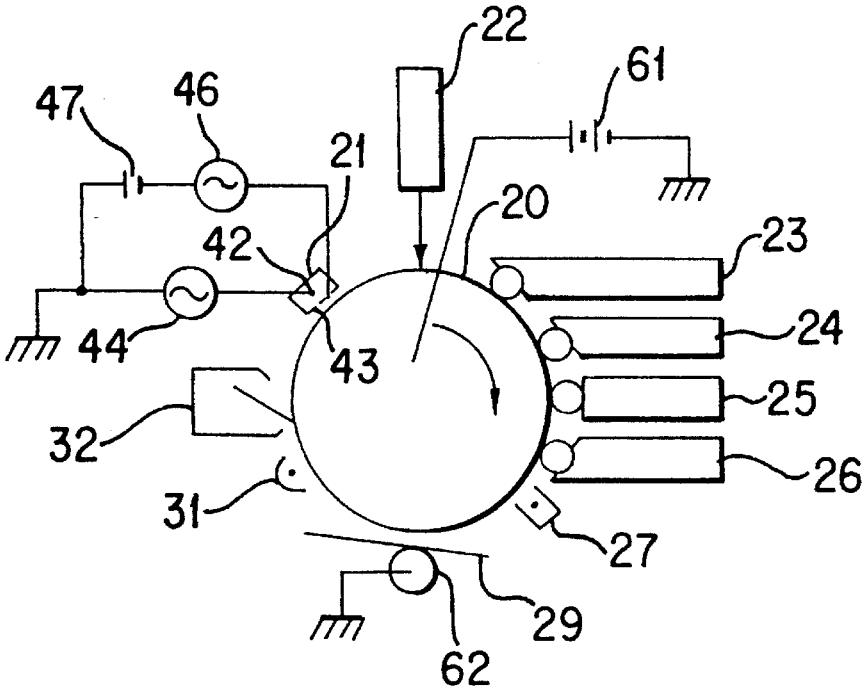
FIG. 13 is an explanation diagram showing configuration of a color image forming apparatus according to the fourth embodiment.

FIG. 13 shows the embodiment 4 of a color image forming apparatus to which the present invention is applied.

In FIG. 13, the color image forming apparatus according to this embodiment is nearly similar to that in the embodiment 3, but being different from the embodiment 3, a transfer roll 62 grounded is arranged in opposition to the transfer position of the photosensitive drum 20. Similar components to those in the embodiment 3 are designated by similar numerals and the detailed description shall be omitted here.

According to this embodiment, each toner image of yellow, magenta, cyan, black is formed on the photosensitive drum 20 through image forming process similar to that in the embodiment 3. And then the charging amount necessary for the charging is supplied to each toner image by a pretransfer charging device 27. Subsequently each color toner image adhering to the photosensitive drum 20 is transferred collectively by the grounded transfer roll 62 to the recording paper 29.

In the transfer process of this embodiment, since the bias necessary for the transfer is applied between the photosensitive drum 20 and the transfer roll 62 by the DC voltage applied to the conductive substrate of the photosensitive drum 20, the transfer power source becomes unnecessary although it was necessary in the prior art.

Further in this embodiment, if an image carrier of belt shape is used in place of the photosensitive drum 20 for example and executing positions of each process of charging, development and transfer are arranged in spacing, the DC voltage applied to the conductive substrate of the image carrier may be changed and selected in the developing process and other process.

Embodiment 5

Figure 14:
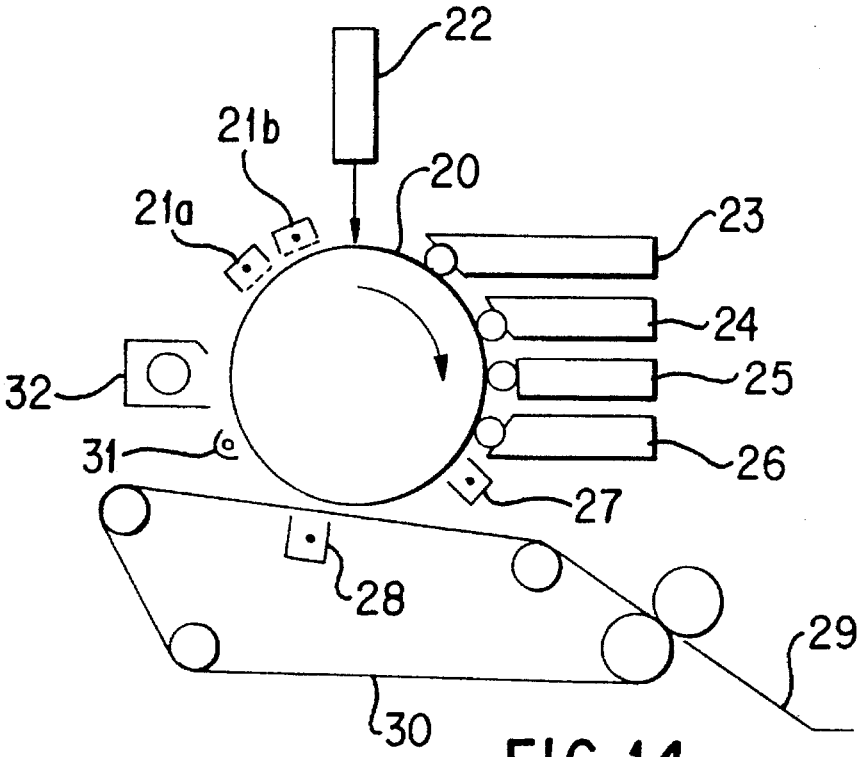
FIG. 14 is an explanation diagram showing configuration of a color image forming apparatus according to the fifth embodiment.

Basic configuration of a color image forming apparatus according to the embodiment 5, as shown in FIG. 14, is nearly similar to that in each embodiment as above described, but being different from each embodiment, a first charging device 21*a* used in image forming cycle of the first color and a second charging device 21*b* used in image forming cycle of the second color or later are provided. Components in FIG. 14 common to those in each of the embodiments are designated by common numerals, and the detailed description shall be omitted here.

Figure 15:
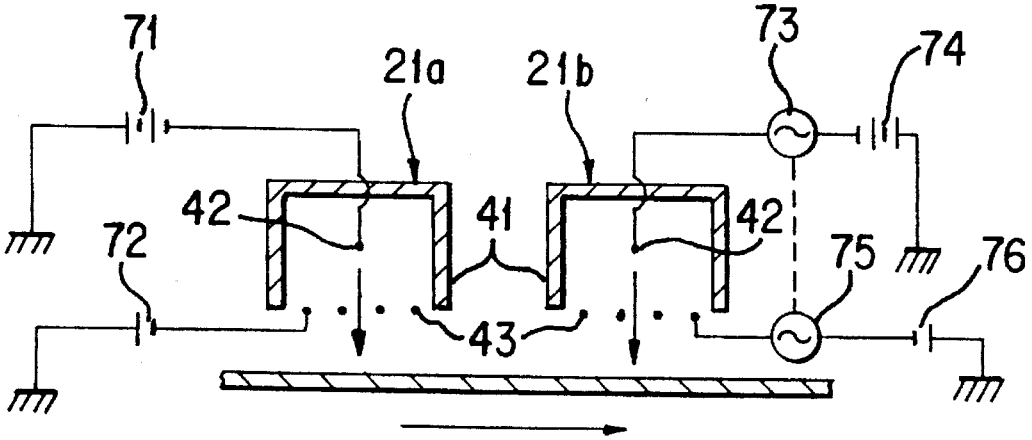
FIG. 15 is an explanation diagram showing details of a charging device according to the fifth embodiment.

In this embodiment, the first charging device 21*a* and the second charging device 21*b*, as shown in FIG. 15, are provided with a discharge wire 42 arranged within a shield 41 and a grid 43 arranged at opening portion of the shield 41. In the first charging device 21*a*, a DC power source 71 for generating charges in the charging polarity of the photosensitive drum 20 is connected to the discharge wire 42, and a DC power source 72 for DC bias (corresponding to the charging potential of the photosensitive drum in this embodiment) is connected to the grid 43. On the contrary, in the second charging device 21*b*, an AC power source 73 for generating charges in the positive polarity and the negative polarity and a DC power source 74 for superposing prescribed DC voltage component are connected to the discharge wire 42, and a DC power source 75 for applying DC bias (corresponding to the charging potential of the photosensitive drum 20 in this embodiment) and an AC power source 76 applying AC voltage in the same phase as the AC voltage for the discharge wire 42 are connected in series to the grid 43, and the AC voltage conditions (frequency, peak-to-peak amplitude) from the AC power source 76 are set to similar range to that of the embodiment 1.

According to this embodiment, the first charging device 21*a* acts in the image forming cycle of the first color and the second charging device 21*a* acts in the image forming cycle of the second color or later.

Therefore in the image forming cycle of the second color or later, similar action to that of each of the above-mentioned embodiments is effected, but in the image forming cycle of the first color, since the DC voltage from the DC power source 71 is applied to the discharge wire 42 of the charging device 21*a*, only charge in the same polarity to the charging polarity of the photosensitive drum 20 is produced from the discharge wire 42 and then is led to the side of the photosensitive drum 20 thereby the initial charging efficiency too the photosensitive drum 20 in the image forming cycle of the first color further rises.

According to the present invention as above described, in a color image forming apparatus where charging, exposure and development are repeated and plural color component toner images are formed on an image carrier and then transferred collectively to an image receptor, since a scorotron charging device is used as a charging device to be used in color image forming cycle of at least the second color or later and AC voltage condition applied to a grid is optimized thereby rise of the toner layer potential on the image carrier is suppressed to the utmost and the reversal charging phenomenon at the uppermost layer of the toner layer is avoided, even if the color superposing of the toner images is executed, the development due to the high latent image contrast potential can be carried out and moreover the toner scattering phenomenon and the reversal development phenomenon caused by the reversal charging phenomenon at the uppermost layer of the toner layer can be avoided effectively.

Consequently even if the color superposing of the toner images is executed, the color image with good image quality being excellent in the chromaticness and without disorder can be obtained.

Also according to the present invention, since configuration of the existing charging device is followed as it is and a simple mechanism may be used, the apparatus configuration is not complicated unnecessarily.

Also if the DC voltage condition applied to the grid is set to the optimum, the image carrier can be simply charged to the desired charging potential level.

Further if the image carrier power source for applying the DC voltage is connected to the conductive substrate of the image carrier, for example, the DC voltage of the image carrier power source is set to that having the opposite polarity to and the same amount as the DC voltage component superposed on the discharge electrode or the grid of the scorotron charging device, thereby the DC power source of the discharge electrode or the grid can be omitted.

In a type of connecting the image carrier power source for applying the DC voltage to the conductive substrate of the image carrier, further if the transfer electrode of the collective transfer means is grounded and the DC voltage of the image carrier power source is selected corresponding to the transfer bias, the power source for transfer can be omitted.

What is claimed is:

1. A color image forming apparatus comprising:

an image carrier with a sensitive medium formed on a conductive substrate;

charging means for charging said image carrier in each color component image forming cycle;

exposure means for forming an electrostatic latent image corresponding to each color component image on said image carrier in each color component image forming cycle;

multi-color development means for toner-developing the electrostatic latent image corresponding to each color component image in each color component image forming cycle; and collective transfer means for transferring collectively a plurality of color component toner images formed on said image carrier to an image receptor, wherein said charging means used in the image forming cycle of at least the second color or later is composed of a corona charging device having a discharge electrode and a grid with corona ion flow control voltage applied thereto, an electrode power source applying at least AC voltage is connected to said discharge electrode, and a grid power source applying at least AC voltage in nearly the same phase as that of the AC voltage applied to the discharge electrode is connected to said grid, and the frequency of the AC voltage from said grid power source is set to not less than 50 Hz and not more than 5 kHz.

2. A color image forming apparatus comprising:

an image carrier with a sensitive medium formed on a conductive substrate;

charging means for charging said image carrier in each color component image forming cycle;

exposure means for forming an electrostatic latent image corresponding to each color component image on said image carrier in each color component image forming cycle;

multi-color development means for toner-developing the electrostatic latent image corresponding to each color component image in each color component image forming cycle; and collective transfer means for transferring collectively a plurality of color component toner images on said image carrier to an image receptor, wherein said charging means used in the image forming cycle of at least the second color or later is composed a corona charging device having a discharge electrode and a grid with corona ion flow control voltage applied thereto, an electrode power source applying at least AC voltage is connected to said discharge electrode, and a grid power source applying at least AC voltage in nearly the same phase as that of the AC voltage applied to the discharge electrode is connected to said grid, and the peak-to-peak amplitude of the AC voltage from said grid power source is set to not less than 50 Vp-p and not more than 2 kVp-p.

3. A color image forming apparatus as set forth in claim claim 1, wherein said grid power source superposes DC voltage so that the charging potential level of the image carrier is included within range of the applied voltage to said grid.

4. A color image forming apparatus as set forth in claim 1, wherein said electrode power source or said grid power source applies only AC voltage component to said discharge electrode or said grid, and an image carrier power source applying the DC voltage component is connected to the conductive substrate of said image carrier.

5. A color image forming apparatus as set forth in claim 4, wherein the transfer electrode of said collective transfer means is grounded.

* * * * *